United States Patent [19]

Tomiyasu et al.

[11] Patent Number: 4,611,763

[45] Date of Patent: Sep. 16, 1986

[54] METHOD AND APPARATUS FOR CONTROLLING A GRINDING MILL

[75] Inventors: Hiroshi Tomiyasu; Masahiro Hattori, both of Yokohamashi; Yoshio Itoh, Ichiharashi, all of Japan

[73] Assignee: Sankyo Dengyo Co. Ltd., Japan

[21] Appl. No.: 639,350

[22] Filed: Aug. 10, 1984

Related U.S. Application Data

[63] Continuation-in-part of Ser. No. 377,967, May 13, 1982, abandoned.

[30] Foreign Application Priority Data

May 27, 1981 [JP] Japan ..... 56-80508

[51] Int. Cl.[4] ..... B02C 25/00

[52] U.S. Cl. ..... 241/30; 241/33; 241/34

[58] Field of Search ..... 241/30, 33, 34, 35, 241/36, 37; 364/154

[56] References Cited

U.S. PATENT DOCUMENTS

| | | | |
|---|---|---|---|
| 3,314,614 | 4/1967 | Daniel et al. | 241/34 X |
| 3,358,938 | 12/1967 | Brown | 241/34 X |
| 3,568,939 | 3/1971 | Brewster et al. | 241/30 X |
| 3,693,163 | 9/1972 | Johnson et al. | 364/154 X |

*Primary Examiner*—Howard N. Goldberg
*Assistant Examiner*—Joseph M. Gorski
*Attorney, Agent, or Firm*—Steinberg & Raskin

[57] ABSTRACT

Method and apparatus for automatically controlling a grinding mill in a mill arrangement which includes a grinding mill, raw material feed apparatus and a controller wherein one or more signals indicative of the condition of the mill are input to the controller and compared therein to a set point to generate an output signal based on the comparison and wherein the output signal is input to the raw material feed apparatus to adjust the rate at which raw material is fed into the grinding mill include an arrangement wherein the output signal of the controller is integrated for a predetermined time to obtain a first integrated quantity, the controller set point is then automatically varied a predetermined amount in a predetermined direction such that a second controller output signal is generated, the second controller output signal is then integrated for the predetermined time to obtain a second integrated quantity, the first and second integrated quantities are then compared, and the controller set point is then automatically varied a predetermined amount in a direction determined by the comparison of the first and second integrated quantities such that a third controller output signal is generated. The third controller output signal is integrated for the predetermined time to obtain a third integrated quantity, and then after redesignating the second and third integrated quantities as the first and second integrated quantities, repeating the above steps.

7 Claims, 5 Drawing Figures

METHOD AND APPARATUS FOR CONTROLLING A GRINDING MILL

BACKGROUND OF THE INVENTION

This application is a Continuation-In-Part of Application Ser. No. 377,967, filed May 13, 1982, now abandoned.

This invention relates generally to methods and apparatus for controlling a grinding mill and, more particularly, to a method and apparatus for automatically controlling the operation of a grinding mill to maximize its efficiency.

It is known that the operational efficiency of a grinding mill arrangement such as, for example, a ball mill for grinding raw material such as clinker or the like, depends, for any one particular "condition" of the grinding arrangement, upon the load of material being ground within the mill. The condition of a grinding mill or arrangement at any one time depends upon several parameters including the grain or particle size and hardness of the raw material fed to the mill, the rate at which the raw material is fed or charged into the mill, the rate at which coarse or oversized material separated from the mill output is recirculated and re-charged back into the mill for further grinding, the amount, if any, of water added during the milling operation, the temperature of the raw material being charged into the mill, the gradual wear of the grinding elements, e.g., balls, rods and the like, over a period of time, among other factors. If all of these parameters remain substantially constant during the grinding operation, the efficiency of the operation will essentially depend on the amount or load of material being ground within the mill at that time. Thus, there will be a particular load at which maximum operational efficiency will be obtained for any particular condition of a grinding mill arrangement.

It is also known that the condition of a grinding mill arrangement usually varies with continued operation. For example, the grain or particle size and hardness of the material being ground, such as clinker, are often unstable and if the hardness or grain size should, for example, increase during operation of a ball mill, the speed of the mill grinding would correspondingly decrease and the ratio of coarse or oversized material to fine powder forming part of the mill output would increase. In such a case. if the coarse or oversized material of the mill output is separated and recirculated back into the mill and the input flow rate at which new raw material is fed into the mill is maintained constant, the load of material being ground within the mill increases. If the mill was initially being operated with a raw material input flow rate calculated to achieve maximum efficiency, it is seen that continued operation of the mill with that flow rate being maintained constant will cause the load within the mill to increase resulting in a decrease in efficiency as the milling operation continues.

In view of the foregoing, it has been conventional to adjust the feed rate of raw material into the mill in accordance with changes in the grain or particle size and the quantity or load of material being ground in the mill in order to maintain maximum efficiency. These changes have been detected by monitoring changes in mill noise, i.e., the sounds emanating from a mill, during its operation, which change in frequency and amplitude as the material grain size and quantity change. In mill arrangements wherein the coarse or oversized portion of the mill output is separated from the fine powder and recirculated back into the mill, adjustment of the feed rate of new material has also been based on the amount of course material present in the mill output and which is recirculated back into the mill.

Although such feed rate adjustments have usually been performed by trained operators, automatic systems have been proposed for controlling the feed rate of raw material into a grinding mill in an attempt to maintain maximum efficiency. In one prior art arrangement disclosed in U.S. Pat. No. 3,314,614 to S. W. Daniel, et al., signals generated by signal-producing monitoring devices including microphones with sound amplifiers for monitoring mill noise and watt converters for sensing the power consumed by conveyors which carry both the mill output to the separator and the separated coarse grain fraction thereof back to the mill for recirculation, are input into a calculating computer or controller which is provided with a manually adjustable system set point potentiometer which inputs a fixed set point to the computer and with which the signals, appropriately combined, are compared. The controller generates an output signal based on such comparison which is applied to the raw material feed apparatus to adjust the material feed rate.

Automatic systems of the type described above, however, have not proven to be entirely satisfactory since the load within the mill will vary even as the flow rate of new material to be ground is varied in response to the changing condition of the grinding mill arrangement. As noted above, a grinding mill arrangement will have for any particular grinding condition a certain value of the load or quantity of material being ground which will provide a maximum operating efficiency. However, automatic systems of the prior art do no take this fact into account.

SUMMARY OF THE INVENTION

Accordingly, it is an object of the present invention to provide new and improved methods and apparatus for automatically controlling the operation of a grinding mill to maximize efficiency.

Another object of the present invention is to provide a new and improved method and apparatus for automatically controlling the operation of a grinding mill to maximize efficiency and which accounts not only for variations in the condition of the grinding mill arrangement but which, additionally, takes into account the fact that for any particular grinding condition there is a certain desired value of the load within the mill which will provide maximum operating efficiency.

Briefly, the present invention is based on the recognition that for any particular set of parameters defining a particular mill condition, e.g., hardness and particle or grain size of raw material being ground, feed rate, fraction of mill output being recirculated, etc., there is a corresponding particular relationship between mill efficiency and the load within the mill and that therefore for any particular mill condition, there is a certain desired value of the load within the mill that will provide maximum operational efficiency.

According to the present invention, a method and apparatus are provided wherein a controller is utilized which controls the feed of raw material to the mill by comparing an initial set point input thereto with a signal generated by a combination of signals produced by monitoring devices. According to a preferred embodiment of the invention, the output signal of the controller is integrated for a predetermined time whereupon the set point is automatically increased a predetermined amount and the new output signal of the controller is integrated for the same predetermined time. The original and new integrated values are compared. If the new integrated output value is greater than or equal to the original integrated output value, the set point is again automatically increased the predetermined amount and the next new output signal of the controller is again integrated for the same predetermined time. The next new integrated output value is then compared to the immediately preceding integrated output value and, if greater or equal, the set point is again automatically increased the same predetermined amount. This operation is continued until the integrated controller output value obtained is less than the immediately preceding integrated output value whereupon the set point is then decreased a predetermined amount. The output of the controller is then integrated for the predetermined time and compared to the immediately preceding integrated output value. The set point is then automatically decreased or increased the same predetermined amount depending upon whether the last integrated controller output value is greater or less than the immediately preceding one.

In this manner the set point is continuously adjusted to obtain a new material feed rate into the mill which will yield maximum operating efficiency even as the grinding mill condition changes during operation.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
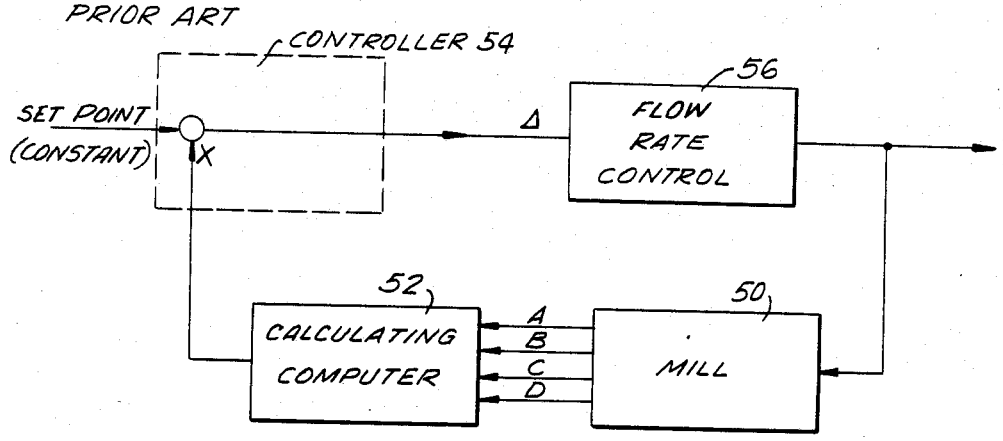
FIG. 1 PRIOR ART
FIG. 1 is a schematic flow diagram illustrating an automatic grinding mill control system according to the prior art.

Referring now to the drawings wherein like reference characters designate identical or corresponding parts throughout the several views and more particularly to FIG. 1, a system for automatically controlling a grinding mill arrangement in accordance with the prior art, such as the system disclosed in the above-mentioned U.S. Pat. No. 3,314,614, is illustrated. As the grinding mill 50 operates, signals A, B, C and D are generated and are input into a calculating computer 52. For example, signals A and B may be amplified signals produced by microphones which monitor mill noise in a pair of successive compartments in the mill. Signals C and D may be signals produced by watt converters which sense the power consumed by a mill output conveyor and separator, respectively. The calculating computer 52 appropriately combines the signals and inputs a signal X derived therefrom into a controller 54. The controller is provided with a potentiometer by which a certain desired fixed set point is applied. The controller 54 generates a signal Δ proportional to the difference between the signal X and the set point. Signal Δ is applied to the flow rate control apparatus 56 which may constitute a raw material feeder to adjust the rate of raw material feed into the mill 50.

As noted above, a system of the type illustrated in FIG. 1 is not entirely satisfactory in that as the operating condition of the mill changes, the load within the mill which will provide maximum operating efficiency also changes. Thus, referring to FIG. 2, curves I and II represent the relationships between mill efficiency and the load within a mill for two particular conditions of the mill arrangement. Thus, when the mill arrangement is operating in a first condition designated by curve I, maximum efficiency is denoted by point A on the curve corresponding to a load within the mill designated C1. It is seen, however, that when the operating condition changes so that the relationship between efficiency and load is designated by the curve II, the maximum efficiency, designated B on curve II, corresponds to a load within the mill designated C2. Since the mill condition is usually not stable but is rather continuously changing, it is generally not known what curve applies, i.e., it is generally not known what mill load corresponds to a maximum efficiency of the grinding mill arrangement.

Figure 4:
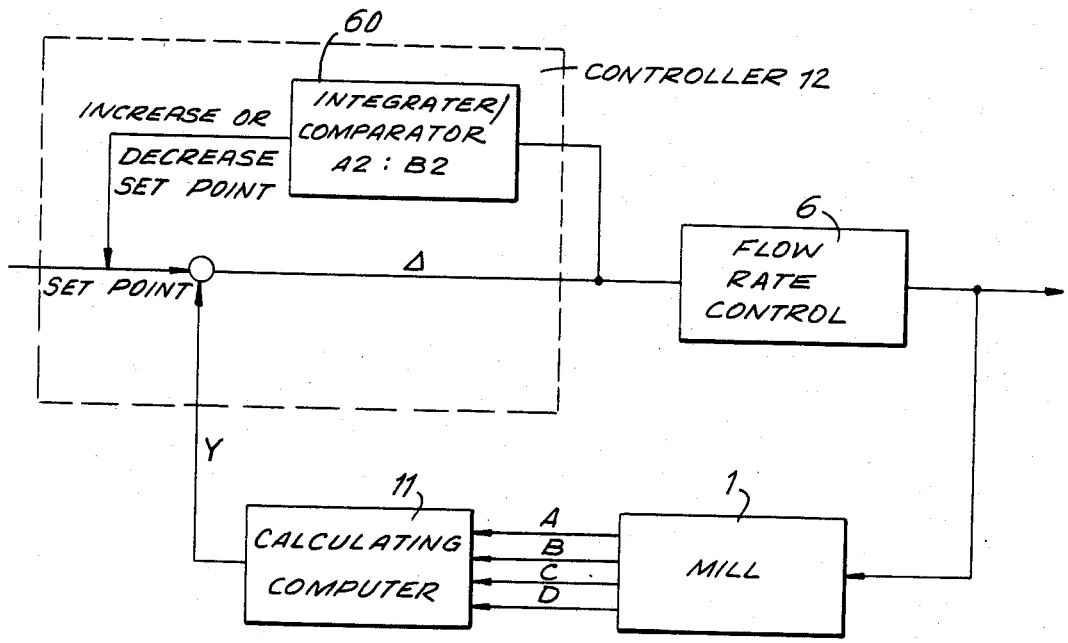
FIG. 4 is a schematic flow diagram similar to FIG. 1 illustrating an automatic grinding mill control system in accordance with the present invention utilized in conjunction with the apparatus illustrated in FIG. 3.
Figure 3:
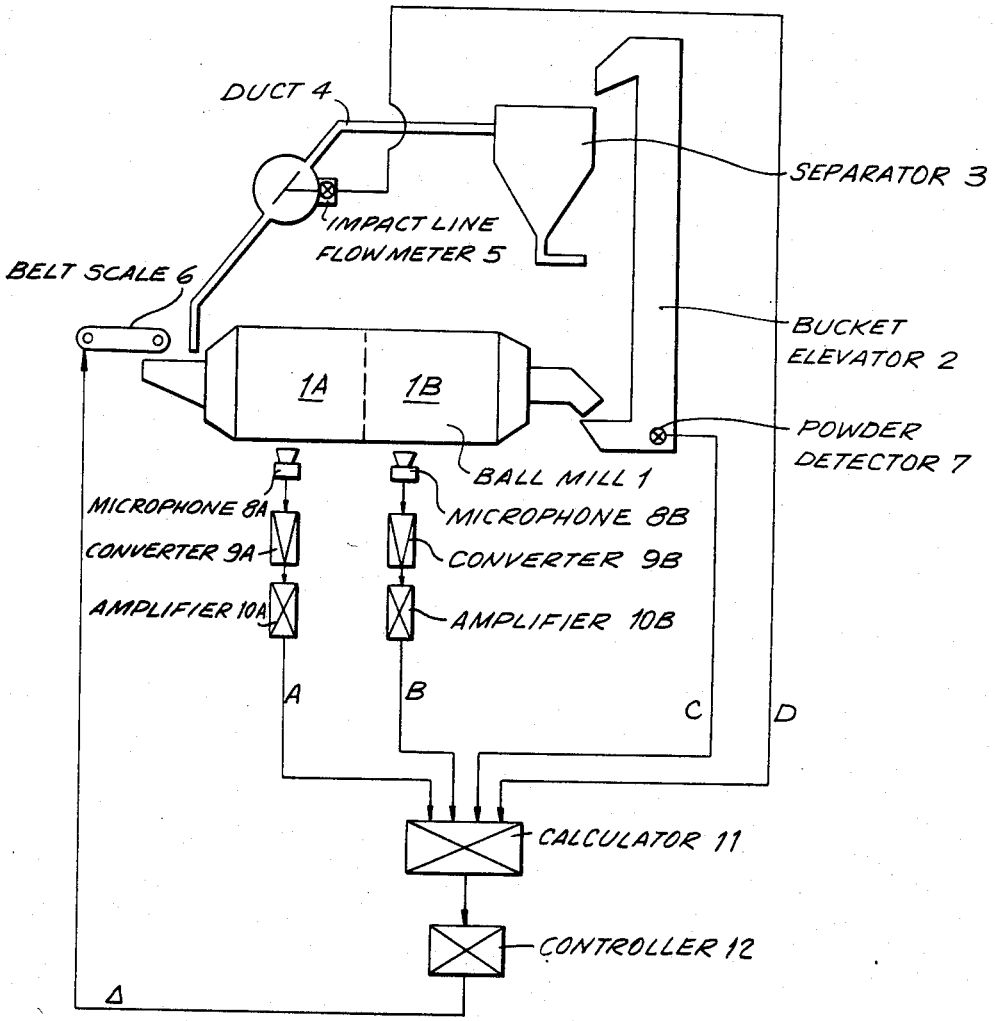
FIG. 3 is a schematic diagram illustrating apparatus in accordance with the present invention.

According to the present invention, the controller is adapted to automatically search for the appropriate set point which will provide a load within the mill which will yield maximum efficiency at any particular time during operation. Referring to FIGS. 3 and 4 wherein one embodiment of a grinding arrangement according to the present invention is schematically illustrated, microphones 8A and 8B are provided to monitor sounds within compartments 1A and 1B of a ball mill 1. Additional microphones may be used, if desired. The microphones 8A and 8B are provided in operative proximity with the first and second compartments 1A and 1B, respectively, of the mill 1 and produce electrical signals corresponding to the sounds in the compartments. The output signals A of the microphones 8A are transmitted to a first input of a calculator 11 via a converter 9A and an amplifier 10A connected in series circuit arrangement with the microphone. The output signals B of the microphone 8B are transmitted to a second input of the calculator 11 via a converter 9B and an amplifier 10B connected in series circuit arrangement with the microphone.

The microphones 8A and 8B, converters 9A and 9B, amplifiers 10A and 10B and calculator 11 comprise conventional devices and/or circuits known in the art. The powder, or ground clinker, discharged from the ball mill 1 is fed to a bucket elevator 2 of any suitable known type which transports it to a separator 3. The separator 3 is of any conventional known type and functions in a known manner to separate the mill output into fine and coarse fractions.

The separated fine fraction is fed to a hopper (not shown) and constitutes the finished output product of the mill. The separated coarse fraction is recirculated back to the input of the mill 1 via a duct 4. A belt scale or weighing feeder 6 of any suitable type feeds raw material, e.g., clinker, to the mill 1 in a known manner under the control of a controller 12.

The quantity of the ground material discharged from the mill which is transported by the bucket elevator 2 is monitored by a detector 7 of any suitable known type, such as a watt converter which monitors the power consumed by the elevator motor. The detector 7 is electrically connected to a third input of the calculator 11 and transmits a signal C thereto corresponding to the quantity of material discharged. The flow rate of the coarse fraction in the duct 4 is monitored by an impact line flow meter 5 of any suitable known type, positioned in duct 4. The impact line flow meter 5 is electrically connected to a fourth input of the calculator 11 and transmits a signal D thereto corresponding to the quantity of coarse fraction being recirculated. The calculator 11 has an output Y which is input to the controller 12. It will be understood that signals A-D are indicative of the "condition" of the mill at any particular time.

The controller 12 produces an output electrical signal Δ which is transmitted to the belt scale 6 to control the rate of feeding of raw material to the mill 1 in accordance with the variation, magnitude, or intensity of signal Δ. The calculator 11 generally functions to multiply the electrical signals A, B, C and D supplied to each of its inputs by corresponding predetermined coefficients. The products are added by the calculator 11 to provide a signal Y indicative of the sum which in turn is indicative of the condition of the mill arrangement, which is transmitted to the input of the controller 12. The controller 12 has an initial set point programmed into it and continuously compares the set point with the signal Y received from the calculator 11 to generate a signal Δ proportional to the difference between the set point and signal Y. The signal Δ is applied to the belt scale to adjust the feed rate of raw material into the mill in an amount determined by the signal Δ.

The set point initially programmed in controller 12 is that at which the mill 1 will operate at maximum efficiency for an assumed existing condition of the grinding mill arrangement. If the operating condition of the mill 1 remains unchanged, there is no need to vary or adjust the set point of the controller 12. However, the operating condition of the mill 1 will generally vary with time as described above.

Referring back to FIG. 2 and assuming that the operating condition of the mill arrangement at the time in question is represented by curve I, in an area A1 of the curve shown in FIG. 2, the efficiency of the mill arrangement will increase with an increase of the load within the mill in the region designated A1. In other words, the greater the quantity of raw material fed into the mill 1 by the belt scale 6, the greater the efficiency of the mill arrangement. Accordingly, if the load within the mill is in the region designated A1, the magnitude of the output signal Δ of the controller 12 should be increased to increase efficiency. This may be accomplished by increasing the set point of the controller.

On the other hand, in an area B1 of the curve I, a decrease in the load within the mill will result in greater efficiency of the mill arrangement and the maximum operating efficiency of the mill can be attained by decreasing the set point of the controller 12.

Figure 2:
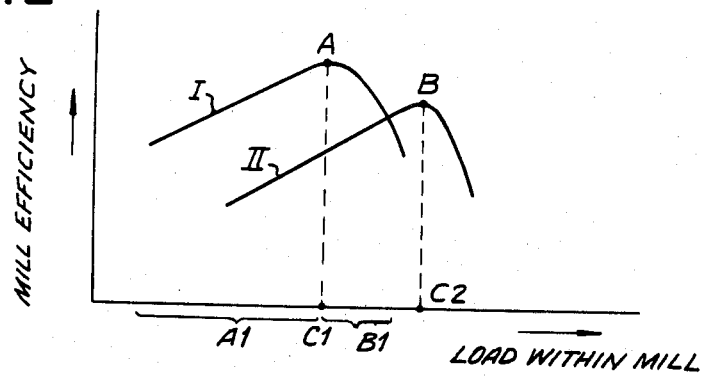
FIG. 2 is a graphical illustration of the variation of mill operating efficiency with load within the mill for two particular grinding mill conditions.

As shown in FIG. 2, the load within the mill corresponding to maximum operating efficiency of the mill arrangement for the operating condition designated by curve I is C1. Therefore, the most suitable set point of the controller 12 corresponds to the load within the mill designated by point C1. However, since the efficiency versus load curve is continuously changing due to changes in the mill operating condition, the point C1 is not constant.

Figure 5:
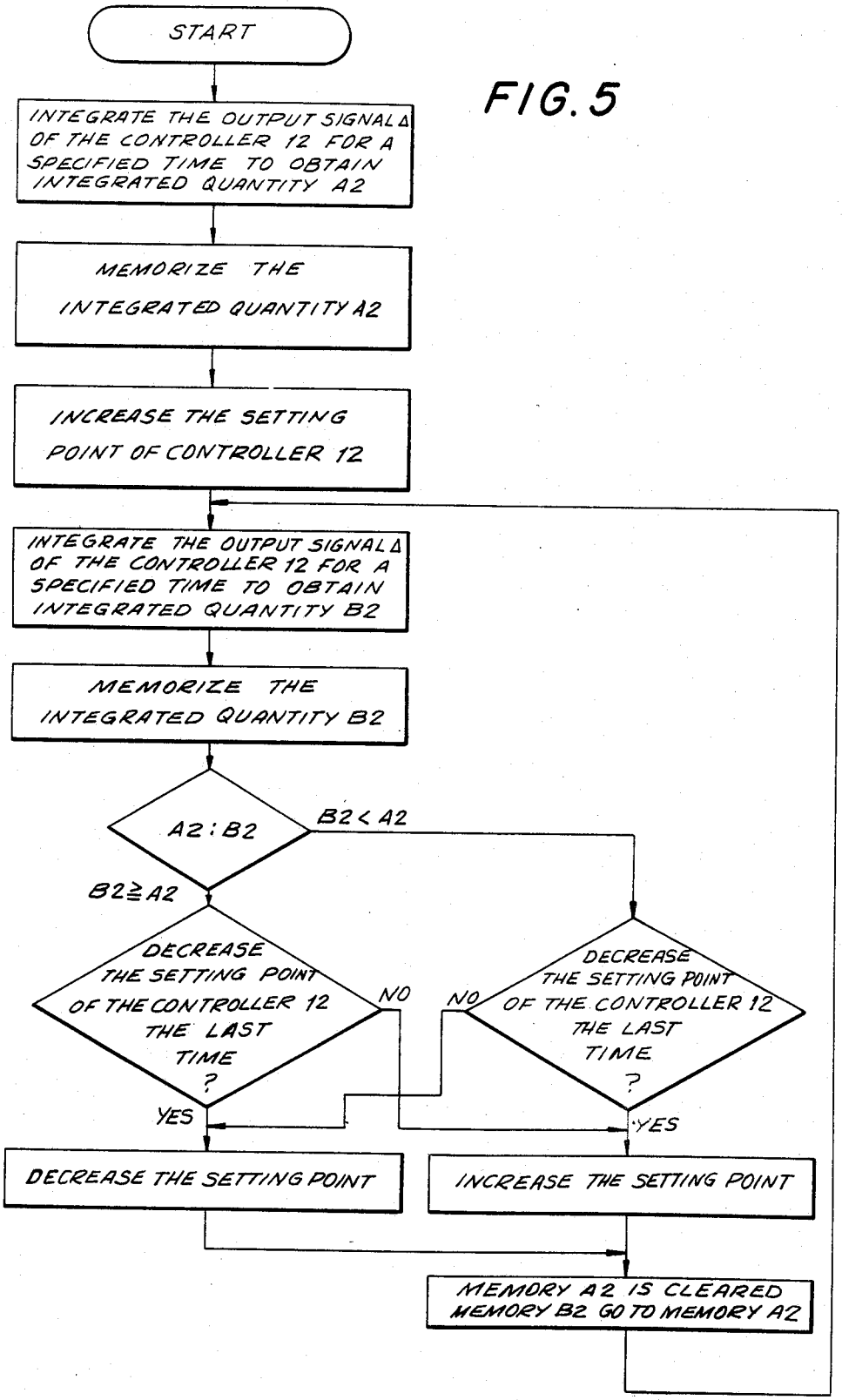
FIG. 5 is a schematic flow diagram illustrating aspects of the operation of the controller in accordance with the method and apparatus of the present invention.

Referring to FIGS. 4 and 5, in accordance with the method and apparatus of the invention, in order to adjust the raw material feed rate to provide the load within the mill which corresponds to maximum efficiency for the particular operating condition of the mill arrangement, the output signal Δ of the controller 12 is fed back to an integrator/comparator 60 forming part of controller 12 which integrates the output signal over a predetermined time to obtain an integrated quantity A2 which is retained in the memory of the integrator/comparator. The set point is then automatically increased a predetermined amount which results in a new controller output signal Δ1. The new controller output signal Δ1 is integrated over the same period of time to obtain a new integrated value B2 which is retained in the controller's memory. The integrated values A2 and B2 are compared by the integrator/comparator. If B2 is greater than A2 the controller 12 again automatically increases the set point the same predetermined amount and again integrates the new controller output Δ2 over the same period of time and again compares the value of the new integrated output signal with the value of the integrated output signal of the controller obtained immediately prior to the last set point increase. The controller 12 repeats this process until it determines that the value of the integrated output signal of the controller after the last set point increase is smaller than the value of the integrated output signal of the controller obtained immediately prior to the last set point increase. The decrease of the integrated value of the controller output is an indication that the mill load has passed through the area A1 and the point C1 of curve I (FIG. 2) into the area B1.

At this stage, the controller 12 automatically decreases the set point by a predetermined amount and integrates the output signal Δ over a prescribed period of time. If the value of the integrated controller output signal after the set point decrease is greater than the value of the integrated output signal of the controller obtained immediately prior to the last set point decrease, the set point is automatically decreased again. On the other hand, if the integrated value of the output signal Δ after the set point decrease is less than or equal to the value of the integrated output signal obtained immediately prior to the last set point decrease, the set point is automatically increased. This process is repeated continuously during the operation of the mill arrangement. In this manner, the controller 12 automatically determines and sets the most suitable set point for maximum operating efficiency of the mill, corresponding to the mill load at point C1 of FIG. 2, assuming the mill is operating at that time along a curve designated I.

FIG. 5 is a flow chart illustrating the operation of the integrator/comparator 60 of the controller 12. As shown in FIG. 5, when a start signal is received by the controller 12, the integrator/comparator 60 initiates the integration of the output signal Δ of controller 12 for a predetermined period of time. The integrated quantity A2 is recorded or memorized in the controller 12. The controller 12 then increases the set point a predetermined amount and the new controller output signal Δ is integrated for a specified period of time sufficient to ensure that the operation of the mill has become stabilized. The integrated quantity B2 is recorded or memorized in the controller 12.

The controller 12 then compares the quantities A2 and B2. If the quantity B2 is greater than, or equal to, the quantity A2 (and the last variation of the set point was not a decrease thereof), the controller 12 increases the set point again. If the quantity B2 is smaller than the quantity A2 (and the last variation of the set point was not a decrease thereof), the controller 12 decreases the set point. The original quantity A2 is cleared from memory and the quantity B2 is redesignated A2. The controller then integrates the new output signal over the same time period which is sufficient to ensure stabilizing of the operation of the mill to obtain a new quantity B2. If B2 is greater than or equal to A2 and the last variation of the set point was an increase, the set point is again automatically increased a predetermined amount. If the last set point variation was a decrease, the set point is automatically decreased a predetermined amount. On the other hand, if B2 is less than A2 and the last variation of the set point was an increase, the set point is automatically decreased. If the last set point variation was a decrease, the set point is automatically increased. The quantity A2 is then cleared from memory and B2 is reassigned the A2 designation.

The integration, comparison and set point adjustment process described above is preferably repeated on a substantially continuous basis recognizing that the condition of the mill is generally changing continuously. The integrating time and the magnitude of the increase or decrease of the set point depend upon the milling system. The set point of the controller 12 is automatically adjusted in the manner described above and its output signal is always of a magnitude which provides substantially maximum operating efficiency and maximum production of the mill.

The method and apparatus of the invention may be used to control mill grinding by detecting other factors such, for example, as the vibration of the mill, as long as the efficiency of the mill follows a curve similar to those illustrated in FIG. 2.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for automatically controlling a grinding mill in a mill arrangement, the mill arrangement including a grinding mill, a raw material feed apparatus for feeding raw material into the mill at an adjustable rate, and a controller, wherein at least one signal indicative of a condition of the mill is input to the controller and compared to a controller set point in order to generate an output signal based on the comparison and wherein the output signal is input to the raw material feed apparatus to adjust the rate at which raw material is fed into the grinding mill, said method comprising the steps of:

(1) integrating the output signal of the controller for a predetermined time to obtain a first integrated quantity;

(2) automatically varying the controller set point a predetermined fixed amount in one of two directions from a set value, thereby generating a second controller output signal;

(3) integrating the second controller output signal for said predetermined time, thereby obtaining a second integrated quantity;

(4) comparing the first integrated quantity with the second integrated quantity;

(5) automatically varying the controller set point a predetermined fixed amount in one of said two directions, which direction is determined by which of said first and second integrated quantities is greater, thereby generating a third controller output signal;

(6) integrating the third controller output signal for said predetermined time, thereby obtaining a third integrated quantity;

(7) redesignating said second and third integrated quantities as first and secind integreated quantities respectively;

(8) continuously repeating steps (4) through (7); and (9) adjusting the rate at which raw material is fed into the mill based upon said output signal generated in step (5).

2. The method of claim 1, wherein the at least one signal indicative of the condition of the mill which is input to the controller includes signals indicative of material load within the mill and material output discharged from the mill.

3. The method of claim 2, wherein said at least one signal further includes a signal indicative of an amount of material output that is discharged from the mill which is recirculated back into the mill.

4. The method of claim 1 wherein said step (2), the controller set point is automatically increased the predetermined fixed amount and wherein in step (5), the controller set point is automatically increased the predetermined fixed amount in a case where said second integrated quantity is greater than said first integrated quantity, and wherein said controller set point is automatically decreased the predetermined fixed amount in a case where said second integrated quantity is less than said first integrated quantity.

5. Apparatus for automatically controlling a grinding mill in a mill arrangement, the mill arrangement including a grinding mill, a raw material feed apparatus for feeding raw material into the mill at an adjustable rate, a controller and at least one device for generating signals indicative of a condition of the mill and wherein signals generated by said devices are input to said controller and compared therein to a controller set point in order to generate an output signal based on the comparison and wherein the output signal is input to said raw material feed apparatus to adjust the rate at which raw material is fed into the grinding mill, said apparatus comprising:

means for integrating the output signal of the controller for a predetermined time to obtain a first integrated quantity;

means for automatically varying the controller set point a predetermined fixed amount in one of two directions from a set value, thereby generating a second controller output signal;

second means for integrating the second controller output signal for said predetermined time, thereby obtaining a second integrated quantity;

means for comparing the first integrated quantity with the second integrated quantity;

second means for automatically varying the controller set point a predetermined fixed amount in one of said two directions, which direction is determined by which of said first and second integrated quantities is greater, thereby obtaining a third controller output signal;

third means for integrating the third controller output signal for said predetermined time, thereby obtaining a third integrated quantity;

means for redesignating said second and third integrated quantities as said first and second integrated quantities, respectively;

means for continuously directing said redesignated first and second integrated quantities to said comparing means; and means for adjusting the rate at which raw material is fed into the mill based upon said output signal generated by said second means for automatically varying.

6. The apparatus of claim 5 wherein said devices for generating signals indicative of the condition of the mill include means for generating signals indicative of material load within the mill and means for generating signals indicative of material output discharged from the mill.

7. The apparatus of claim 6, wherein said devices for generating signals indicative of the condition of the mill further include means for generating a signal indicative of an amount of material output that is discharged from the mill which is recirculated back into the mill.

* * * * *